US007010883B2

(12) United States Patent
Jaerpsten et al.

(10) Patent No.: US 7,010,883 B2
(45) Date of Patent: Mar. 14, 2006

(54) WINDOW WINDING ARM DEVICE FOR MOTOR VEHICLE

(75) Inventors: Magnus Jaerpsten, Gothenburg (SE); Peter Thelin, Göteborg (SE); Hilmar Dohles, Itzgrund (DE); Frank Faβbender, Coburg (DE); Ulf Keller, Rattelsdorf (DE)

(73) Assignee: Brose Fahrzeugteile GmbH & Co. KG, Coburg, Coburg (DE)

( * ) Notice: Subject to any disclaimer, the term of this patent is extended or adjusted under 35 U.S.C. 154(b) by 0 days.

(21) Appl. No.: 10/432,660

(22) PCT Filed: Nov. 27, 2001

(86) PCT No.: PCT/DE01/04500

§ 371 (c)(1),
(2), (4) Date: Nov. 3, 2003

(87) PCT Pub. No.: WO02/42591

PCT Pub. Date: May 30, 2002

(65) Prior Publication Data

US 2004/0216382 A1 Nov. 4, 2004

(30) Foreign Application Priority Data

Nov. 27, 2000 (DE) ..... 100 58 854
Sep. 1, 2001 (DE) ..... 101 42 973

(51) Int. Cl.
*E05F 11/44* (2006.01)

(52) U.S. Cl. ..... 49/351; 49/349
(58) Field of Classification Search ..... 49/351, 49/350, 349, 348
See application file for complete search history.

(56) References Cited

U.S. PATENT DOCUMENTS

| | | | | |
|---|---|---|---|---|
| 1,552,419 | A * | 9/1925 | Clas | 49/351 |
| 2,008,517 | A * | 7/1935 | Roethel | 74/89.19 |
| 2,162,075 | A * | 6/1939 | Floraday | 74/89.18 |
| 2,684,257 | A | 7/1954 | Roethel | |
| 3,745,703 | A * | 7/1973 | Francis et al. | 49/103 |
| 3,788,005 | A * | 1/1974 | Mistopoulos, Jr. | 49/103 |
| 3,859,753 | A * | 1/1975 | Marcuzzi | 49/103 |

(Continued)

FOREIGN PATENT DOCUMENTS

DE 43 25 080 A1 1/1995

(Continued)

OTHER PUBLICATIONS

International Search Report of PCT/DE01/04500, dated Apr. 2, 2002.

(Continued)

*Primary Examiner*—Gregory J. Strimbu
(74) *Attorney, Agent, or Firm*—Christie, Parker and Hale, LLP

(57) ABSTRACT

A window lifter has a first lever arm pivoting about a pivotal axis, an output element having a toothed segment with toothing and an opening extending along the toothing, the toothed segment pivoting about the pivotal axis and fixedly connected to the first lever arm, an axle element extending through the opening of the toothed segment, a drive unit which is connected to the first lever arm through the output element, a drive pinion connected to the drive unit which engages the toothing of the toothed segment, a second lever arm having a longer side and a shorter side opposite the longer side, and a slideway in which the axle element is guided. The axle element is mounted on the shorter side of the second lever arm. The second lever arm is pivotally connected to the first lever arm to pivot about an articulation axis spaced from the pivotal axis.

18 Claims, 7 Drawing Sheets

U.S. PATENT DOCUMENTS

| | | | | |
|---|---|---|---|---|
| 4,000,581 | A * | 1/1977 | Fukumoto et al. | 49/103 |
| 4,723,456 | A * | 2/1988 | Kohler et al. | 74/89.18 |
| 4,930,255 | A | 6/1990 | Sea | |
| 5,074,076 | A | 12/1991 | Baloche | |
| 6,041,549 | A | 3/2000 | Schust et al. | |

FOREIGN PATENT DOCUMENTS

| | | |
|---|---|---|
| DE | 44 38 385 A1 | 5/1996 |
| DE | 196 50 265 C1 | 6/1998 |
| DE | 198 28 891 C1 | 7/1999 |
| DE | 198 48 811 A1 | 4/2000 |
| DE | 199 63 555 A1 | 7/2001 |
| EP | 0 566 060 A1 | 10/1993 |
| GB | 742681 | 12/1955 |

OTHER PUBLICATIONS

International Preliminary Examination Report of PCT/DE01/04500, dated Feb. 20, 2003.

English translation of International Preliminary Examination Report (IPER) for International Application PCT/DE01/04500 filed Nov. 27, 2001.

* cited by examiner

Fig. 6
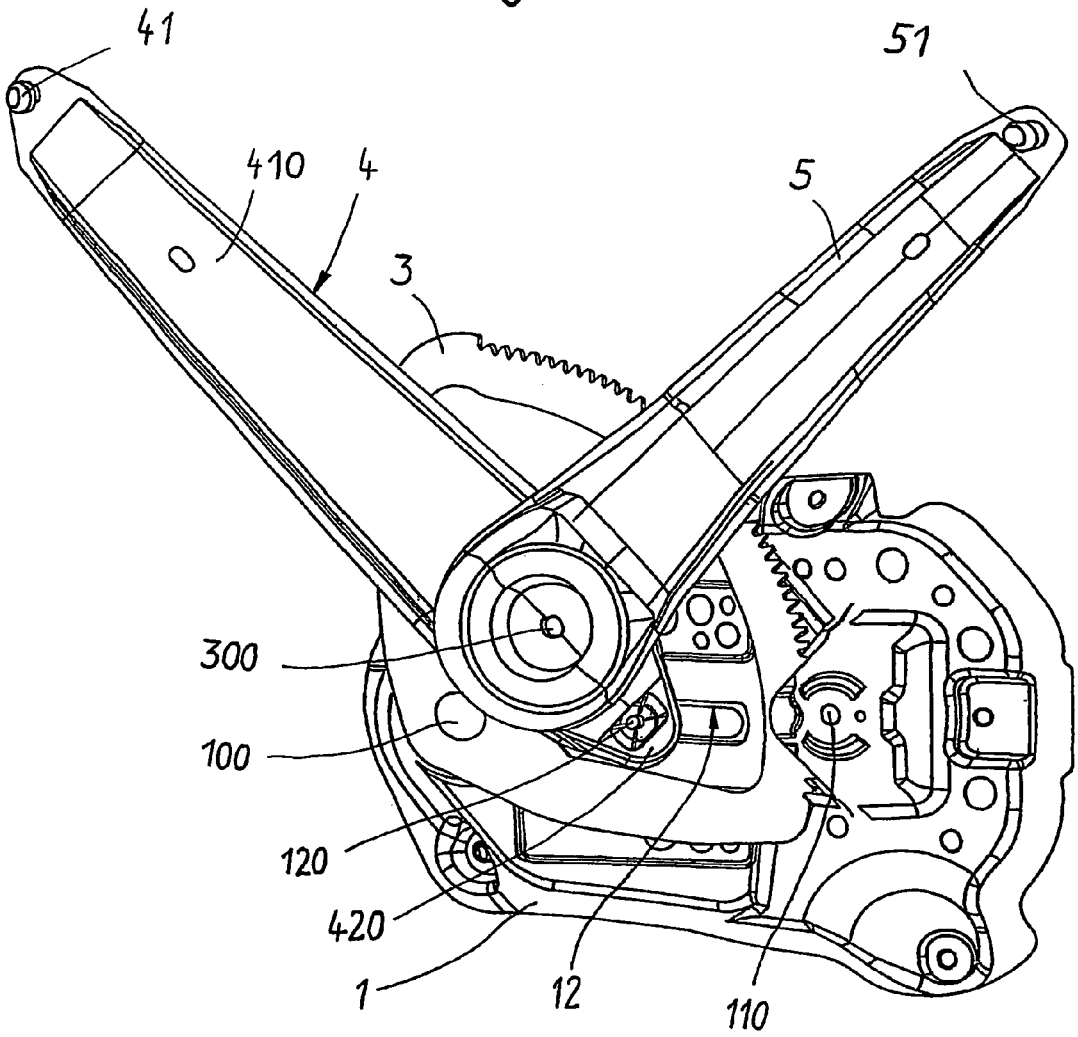
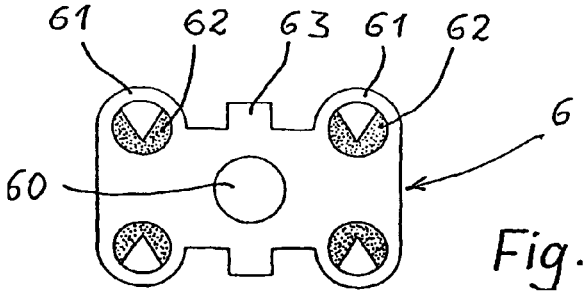
Fig. 7

WINDOW WINDING ARM DEVICE FOR MOTOR VEHICLE

CROSS-REFERENCE TO RELATED APPLICATION

This application is a National Phase Patent Application of International Application Number PCT/DE01/04500, filed on Nov. 27, 2001, which claims priority of German Patent Application Number 100 58 854.9, filed Nov. 27, 2000, and German Patent Application Number 101 42 973.8, filed Sep. 1, 2001.

DESCRIPTION

The invention relates to a window winding arm for a motor vehicle for raising and lowering a vehicle window which is characterised by a compact weight-saving structure and which can be readily installed in a motor vehicle.

BACKGROUND

From DE 196 50 265 C1 a cross-arm window lifter is known whose drive arm is fixedly connected to a toothed segment in the geometrical center of which lies the pivotal axis which is disposed in a base plate. The drive arm is driven by a pinion which engages in the teeth of the toothed segment and which serves as the driven gear element of a motorized or manual drive. At a distance from the pivotal axis of the toothed segment is an articulated cross-arm joint through which the drive lever is connected for articulation to a second lever, the guide arm. One end of each lever arm is connected to sliders which are mounted substantially horizontally displaceable in guide areas of a first slideway fixed on the lower edge of the window. The other end of the guide arm is guided along a second guide rail which is fixed on the door body underneath the first guide rail. The guide arm is hereby controlled relative to the drive arm when the window lifter is actuated.

The window lifter construction described above has proved disadvantageous as far as its sensitivity to tolerance is concerned because the second guide rail fixed in the door body and dedicated to the guide arm has to be positioned relatively accurately with respect to the pivotal axis of the drive arm mounted on the base plate in order to ensure accurate lowering of the window pane. Furthermore the window lifter has a high material requirement and a correspondingly high weight.

A comparatively compact window winding arm is described in DE 198 28 891 C1. This window lifter also has a base plate on which a drive arm with a toothed segment is pivotally mounted, as well as a guide arm which is pivotally connected to the drive arm through an articulated joint. As opposed to the design previously described the second guide rail dedicated to the door body was replaced by a toothed arc with internal toothing in which external toothing connected to the guide lever engages. The external toothing thereby extends concentric with the articulated axis through which the two lever arms are connected together. During raising and lowering of the window pane the guide arm is controlled through the toothed arc, which extends concentric with the pivotal axis of the toothed segment, and the associated external toothing of the guide arm.

The drawback of this window lifter is its large number of parts, particularly with respect to the toothed elements required which furthermore places high demands on compensating the tolerances.

From DE 43 25 080 A1 an adjusting device is known for a window winding arm which is attached to the pane-side end of the one arm. When this adjusting device is actuated the connecting point of this lever arm is changed relative to the connecting point of the other lever arm so that the position of the external contour of the window pane is aligned sufficiently precisely relative to the contour of the window frame. The drawback of this device is that the adjustment can only be undertaken in a relatively widely lowered position of the window pane which makes adjustment difficult since the result of the adjustment can only be assessed after repeatedly closing the window and then corrected several times where necessary. Furthermore the entire adjustment path which may be necessary has to be allowed for in the adjusting device.

Another possibility for adjusting the cross arm window lifter is shown in DE 44 38 385 A1. For the purpose of adjustment the end opposite the window end of the guide lever is mounted adjustable in a separate rail fixed in the door. This adjusting device is very space-intensive.

SUMMARY

The object of the invention is therefore to provide a light and compact window winding arm which is easy to install in a motor vehicle.

In one embodiment, the window winding arm has a first lever arm which is pivotally mounted on a pivotal axis and a second lever arm which is pivotally connected to the first lever arm through an articulated axis spaced from the pivotal axis. The first lever arm is thereby in active connection with a drive unit through an output element. The second lever arm has a longer side and a shorter side opposite the longer side. A supporting axis is disposed in the shorter side of the second lever arm and is guided in a slideway.

The pivotal axis, drive unit and output element are preferably mounted on a base plate in which the slideway is also integrated. The supporting axis is thereby advantageously guided in a displaceable manner in a slide element in the slideway. The ends of the lever arms are advantageously connected to a window pane. The output element is advantageously designed as a toothed segment wherein a pinion of the drive unit engages in the toothing of the toothed segment.

The slideway integrated in the base plate preferably extends between the pivotal axis of the toothed segment and the rotary axis of the drive pinion. The slideway serves in conjunction with the supporting axis fixed on the guide arm to control the guide arm and thus synchronize the pivotal movements of the two lever arms during operation of the window lifter. By making a fixed connection between the drive arm and the output element, which is designed for example by a toothed segment whose toothing points substantially in the direction of the end of the drive arm, and by using a toothed segment having a recess extending along its toothing through which the supporting axis mounted at the short end of the guide arm engages, a particularly compact weight and material saving construction is obtained which furthermore has a reduced number of individual parts. As a result of integrating all the bearing positions and guide areas in the same base plate, the sensitivity to tolerance of the window winding arm is considerably reduced, which has a positive effect on its wear and precision when lowering the window pane.

The distances between the articulated axis of the two lever arms and the supporting axis on the one hand and between the articulated axis and the pivotal axis on the other hand are preferably the same size. As the window is raised and lowered the articulated axis moves over a restricted vertical range whereby the articulated axis crosses the longitudinal axis of the integrated slideway roughly when the window is half opened.

According to a preferred embodiment of the invention, the longitudinal axis of the slideway which is integrated in the base plate extends along an imaginary connection line between the pivotal axis of the toothed segment and the rotary axis of the drive pinion while the articulated axis of the two lever arms lies between the pivotal axis and the toothing of the toothed segment. This provision is hereby made for using the window winding arm in right and left hand vehicle doors without having to make any special adaptations to the parts for either use.

It is however also possible to extend the base plate on the side of the pivotal axis of the toothed segment and to incorporate the slideway into this extended section. In this case the articulated axis of the two lever arms lies on the side of the pivotal axis of the toothed segment which is remote from its toothing. This particular embodiment is not quite as compact as the preferred embodiment described above.

It is advantageous for easier installation of the window winding arm to provide adjusting means for adjusting the relative angular position between the drive arm and the guide arm in the region of the supporting axis. By using adjusting means it is possible to adjust the desired angular position between the lever arms each time and thus to carry out the most accurate adjustment possible of the window pane relative to the window frame of the vehicle door. This is of great importance for the guiding properties and wear behavior of the window pane since a faulty pane adjustment leads to severe friction and thus to an increased power requirement as far as the drive is concerned and to increased wear in the sealing area.

It is advantageous to arrange the adjusting means at a distance from the articulated axis which corresponds at most to a third of the distance between the articulated axis and a connection of the lever arms to a window pane.

According to a preferred embodiment of the invention, the guide arm has on the side of its short lever end, thus in the region of the supporting axis, an adjusting slideway which extends circumferentially relative to the articulated axis which connects the guide arm for articulated movement to the drive arm. This adjusting slideway has an axle element passing through which is associated with a fixing element so that the relative position of the guide arm can be fixed relative to the axle element and thus also relative to the drive arm.

Transversely aligned positive locking elements along the adjusting slideway which can be brought into engagement with close fitting positive locking elements of the fixing element ensure a permanent fixing of the set relative position between the lever arms. The positive locking elements on the guide lever side, e.g. in the form of a toothed area are integrated in the guide arm. Similarly the positive locking elements on the fixing element side are to be integrated in the contact bearing face of a nut or the like.

According to a further embodiment a circular opening is worked into the guide arm in the region of the supporting axis so that an axle element passes through this opening. The axle element can be housed eccentric relative to a base part which can be fixed in different angular positions. In order to fix the desired eccentric position the base part supports on its outer contour a toothed area or the like which can be fitted into the close fitting socket contour in a part of the adjusting device. Naturally the anti-rotation lock of the base part can also be reached through other contours, e.g., through a polygonal design of the interfitting parts. Furthermore a clamping device can however also be provided which positively fixes the desired position of the base part.

The invention will now be explained with reference to the embodiments and the figures in which:

FIG. 1 shows a perspective exploded view of the window winding arm according to the invention having a sliding guide integrated in the base plate and extending substantially along a connecting line between the pivotal axis of the toothed segment and the rotary axis of the drive pinion;

FIG. 2 shows a perspective exploded view of the window winding arm according to the invention having a sliding guide integrated in the base plate and extending on the side of the pivotal axis of the toothed segment remote from the rotary axis of the drive pinion; does not belong to the invention FIG. 3 shows a cross-sectional view through the window winding arm according to FIG. 1 omitting the lever arms;

FIG. 6 shows a view of a double-arm window lifter with a sliding guide integrated in the base plate and with means for adjusting the window lifter in the region of the pivotal axis mounted at the short lever end of the guide lever;

FIG. 7 shows a slider for connecting a pane in the area of the guide bolt mounted at the free ends;

Figure 1:
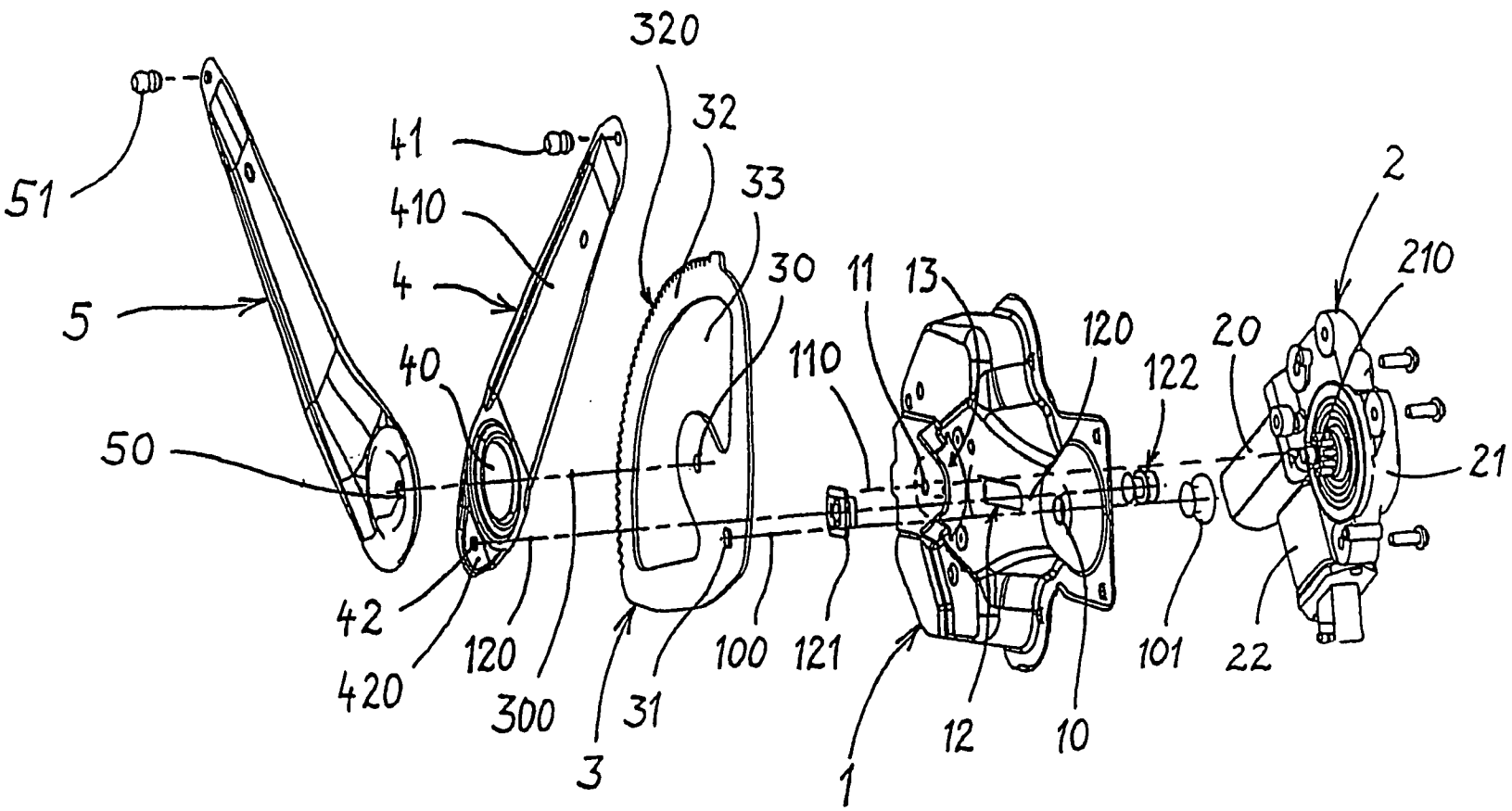

The exploded view of FIG. 1 shows lever arms 4, 5 made by stamping sheet metal and of which the first lever arm 5 is formed as the drive arm and is connected fixedly in the region of the fixing spots (or fixing sites) 30 and 50 to an output element 3 which is formed as the toothed segment. A pot-shaped impression thereby engages through a bearing opening 40 provided in the second lever arm 4 which is designed as the guide arm, whereby an articulated joint with an articulation axis 300 is formed between the lever arms 4, 5. The arrangement of the toothed segment 3 is selected so that its teeth 320 point in the direction of the free end of the drive arm 5, whereby the toothed segment curve 32 is dissected roughly by the drive lever 5.

The toothed segment 3 and thus also the drive arm 5 are swivel mounted in the bearing 10 of the base plate 1 through a rivet bolt 101. A rotary bearing 11 for supporting the axle of the drive pinion 210 of the drive unit 2 which comprises the gearing 21, motor 20 and electronic control unit 22 is provided in the base plate 1 corresponding to the toothed pitch diameter of the toothed segment 3. The engagement of the segment teeth 320 on the teeth of the drive pinion 210 is ensured through a slot 13 worked into the base plate 1.

Figure 3:
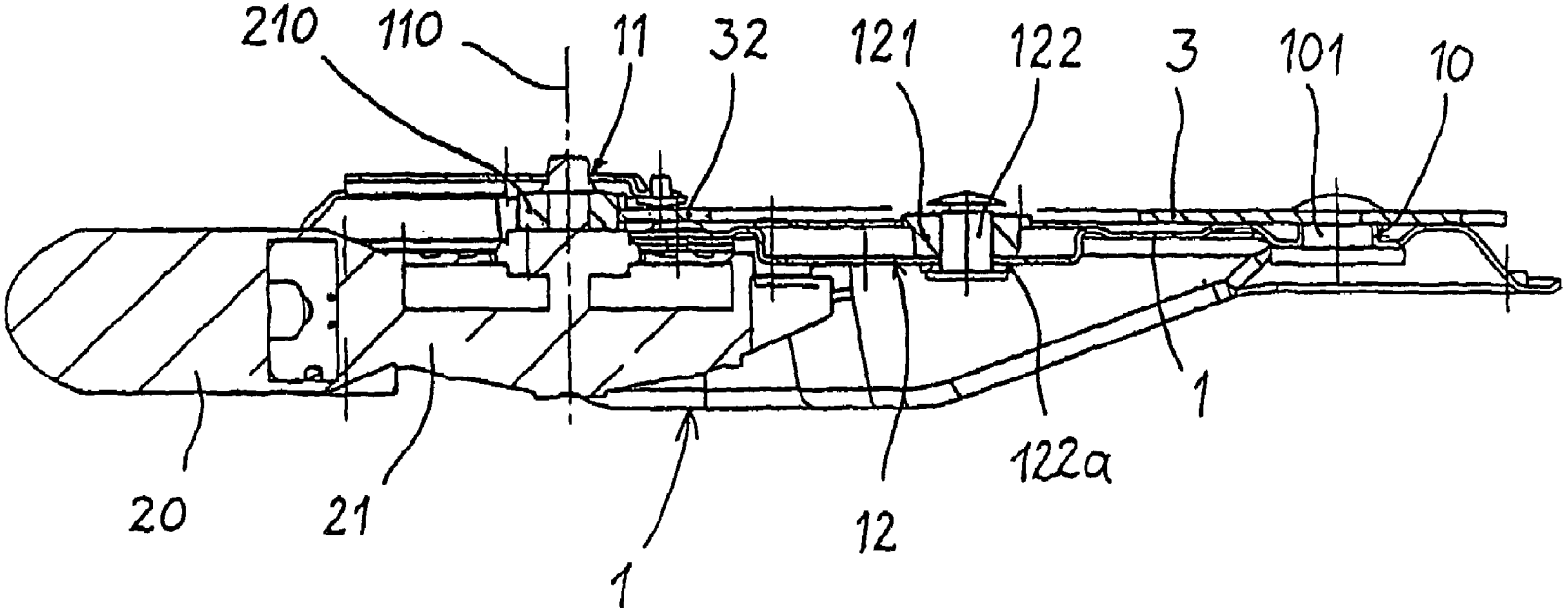

Furthermore a slideway 12 holding a displaceable slider 121 extends in the base plate 1 in line between the pivotal axis 100 and the rotary axis 110 of the drive pinion 210. The slider 121 is secured against the downward pull forces which act in the direction of the support axis 120 through a fixing pin (or element) 122 having a disc 122*a*, as shown in FIG. 3. The short side 420 of the lever arm 4 is connected to the slider 121 through the fixing element 122, which can be a guide bolt. This ensures that the window lifter can be used in left and right hand doors. However, if the plane in which the slideway 12 lies is moved up or down or is inclined relative to the imaginary connecting plane of the axles (or axes) 100 and 110, then it is necessary to make structural changes to the different parts involved in the adjusting kinematics of the device.

Figure 2:
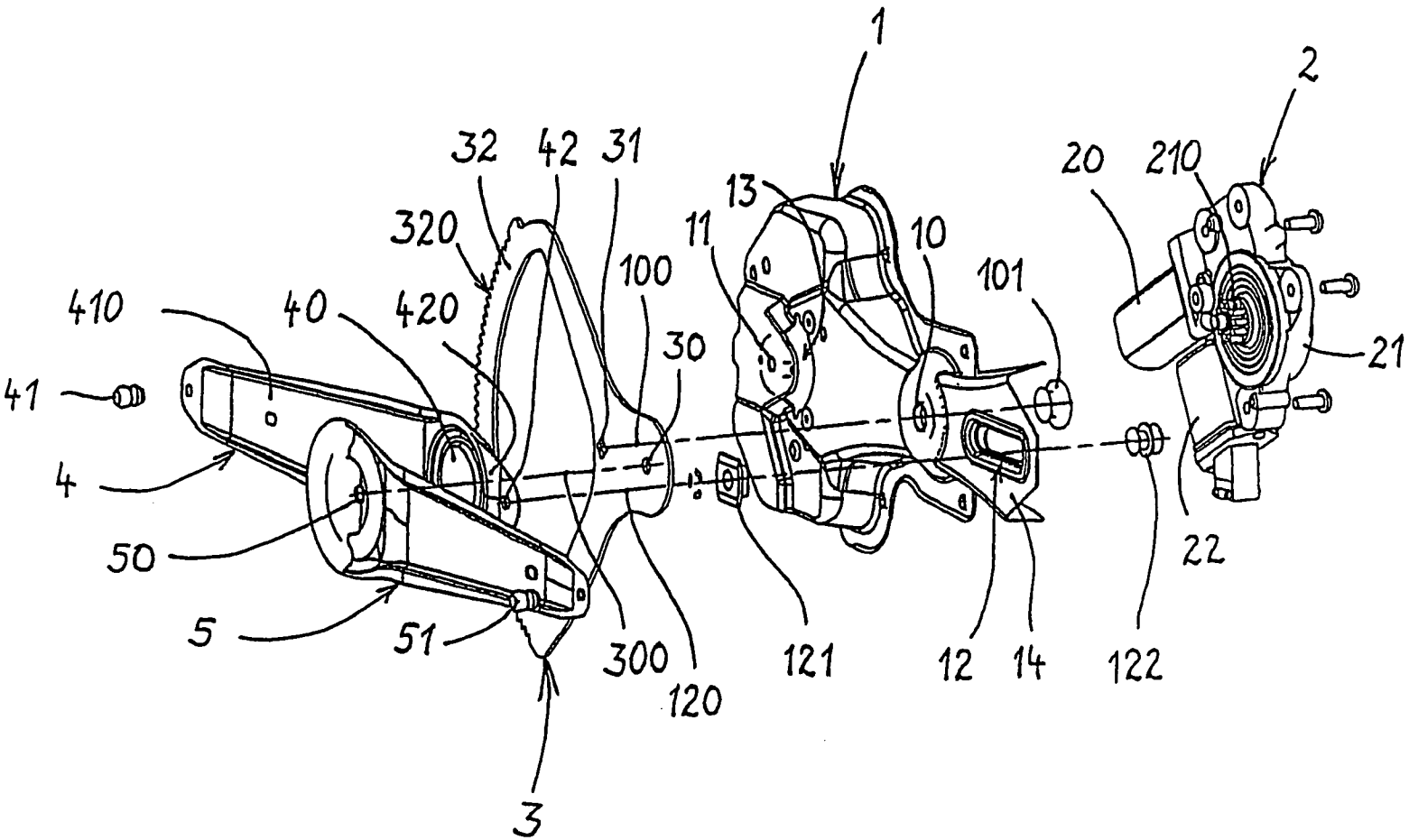

The functional principle of the window winding arm of FIG. 2 is identical with that of FIG. 1. However, this window winding arm does not represent an embodiment of the invention. It only serves for a better comprehension of the invention. The two window lifters only differ in the design details. According to FIG. 2 the articulation axle 300 of the two lever arms 4,5 is mounted on the side of the pivotal axis 100 of the toothed segment 3 remote from the toothing 320, which automatically requires a slideway 12 in a side extension area 14 of the base plate 1. As a result of this different design, the support axis 120 which connects the slider 121 and the shorter side 420 of the lever arm 4 does not engage through the opening 33 of the toothed segment. When necessary, e.g., for reasons of mechanical strength, the opening 33 of the segment 3 can be closed.

Figure 4:
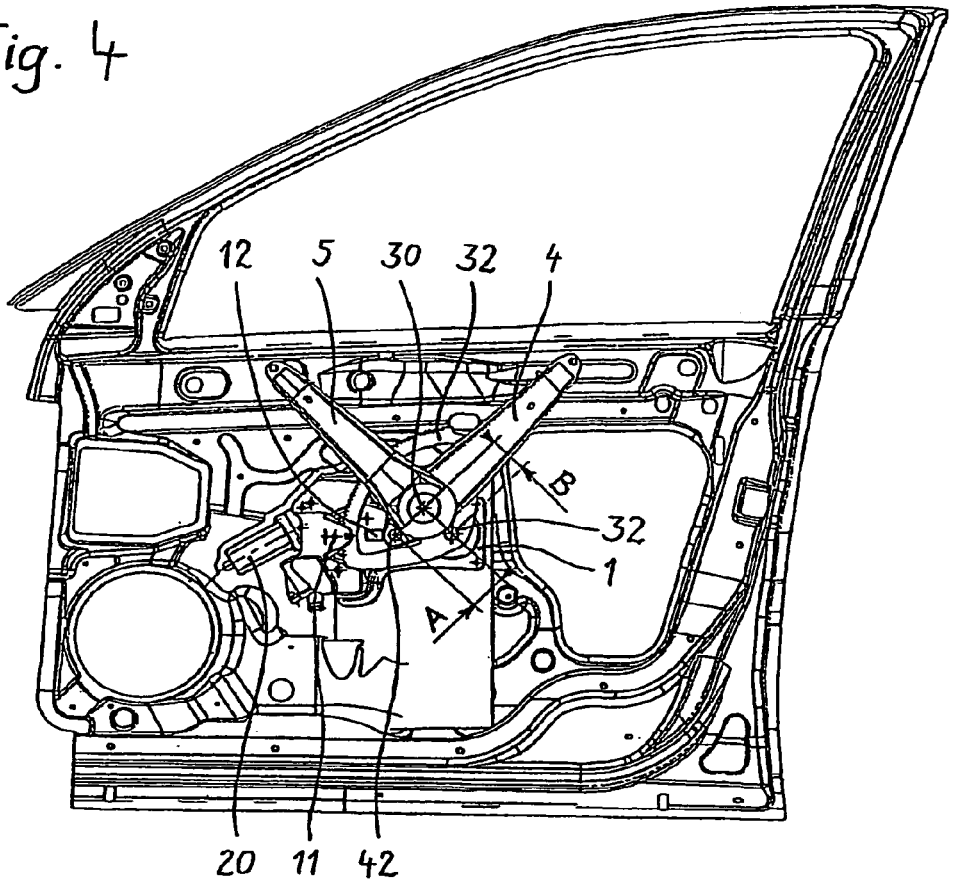
FIG. 4 shows a view of a double-arm window lifter in the fully closed position in a door body.

FIG. 4 shows the position of the individual parts of the window winding arm in the closed position of the window. The slider 121 is thereby located in the right hand edge area of the slideway 12, which is integrated in the base plate 1. The articulation axle (or axis) 300 thereby reaches its highest point. The illustration of the guide rail connected to the window pane, which shows the sliders which are moveably mounted to the guide rail and connected to the guide bolts 41, 51 of the lever arms 4, 5, has been omitted.

Figure 5:
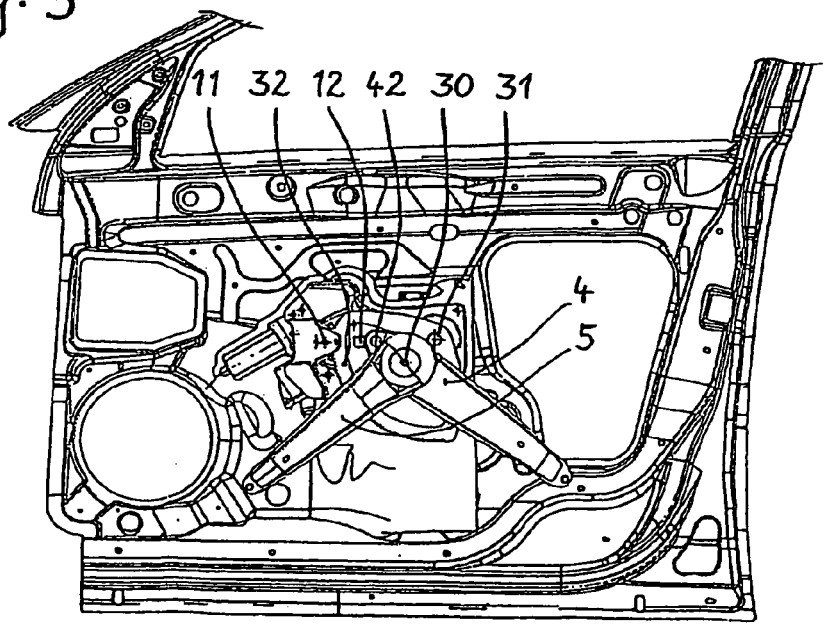
FIG. 5 shows a view of a double-arm window lifter in the fully opened position in a door body.

FIG. 5 shows the lowest position of the window lifter in which the articulation axis 300 is located below the slideway 12. On travelling over the center pane position in which the lever arms 4,5 are aligned substantially horizontally, the slider 121 passes in the slideway 12 into its furthest left position.

FIG. 6 shows the position of the individual parts of the window winding arm in the closed position of the window, as shown also in FIG. 4. The slider 121 is thereby located in the left hand edge area of the slideway 12, which is integrated in the base plate 1. The articulation axis 300 thereby reaches its highest position. In order to adjust the window lifter during installation, additional adjusting means are provided here in the region of the support axis 120 so that the relative position can be adjusted between the two lever arms 4,5.

In order to ensure a good rattle-free guidance of the window pane in the guide rails (not shown here), a slider 6 running therein as shown in FIG. 7 has resilient stops 61 which are mounted displaceable on the guide faces of the illustrated guide rail. A permanent and sufficiently stressable elasticity is achieved by incorporating elastomer 62 into the hollow cavities associated with the resilient stops. The slider 6 is preferably made with the elastomer 612 using so-called twin component technology so that no assembly expense ensues for the elastomer. The rigid stop 63 serves to restrict the deformation of the elastic stops 61.

Figure 8:
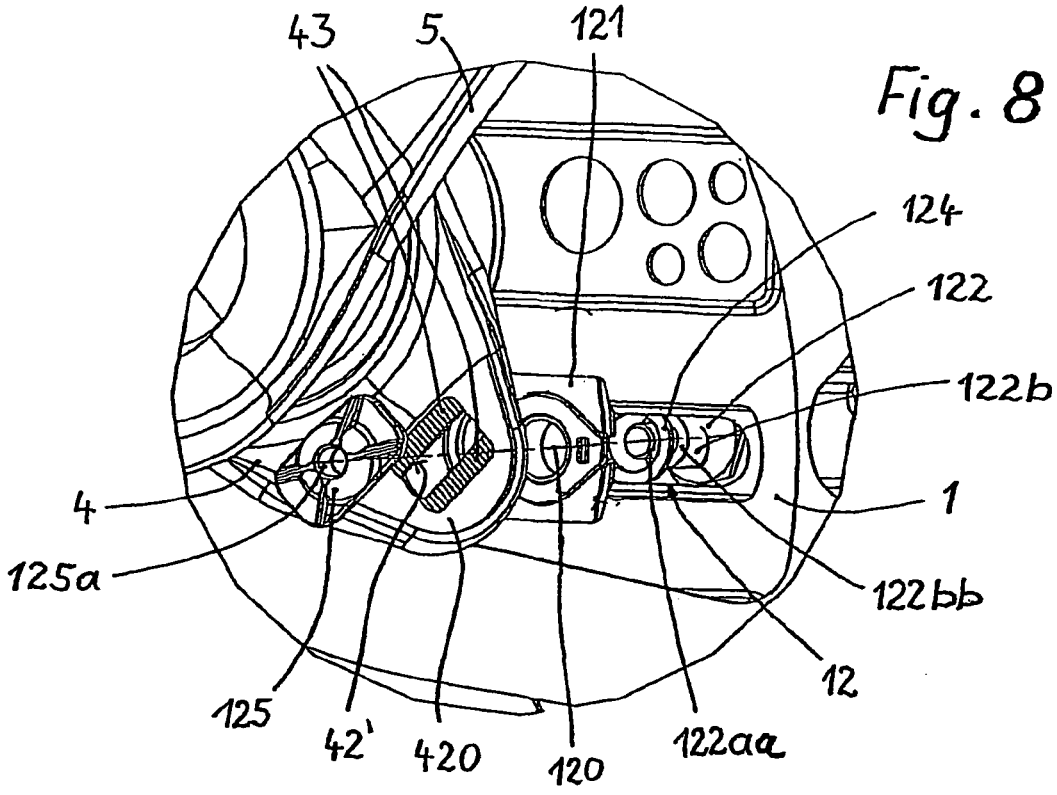
FIG. 8 shows a perspective exploded view of a section of the window lifter in the area of the adjusting means viewed from the side of the lever arms whereby the short lever end of the guide lever has in the region of the pivotal axis a circumferentially extending elongated hole.
Figure 9:
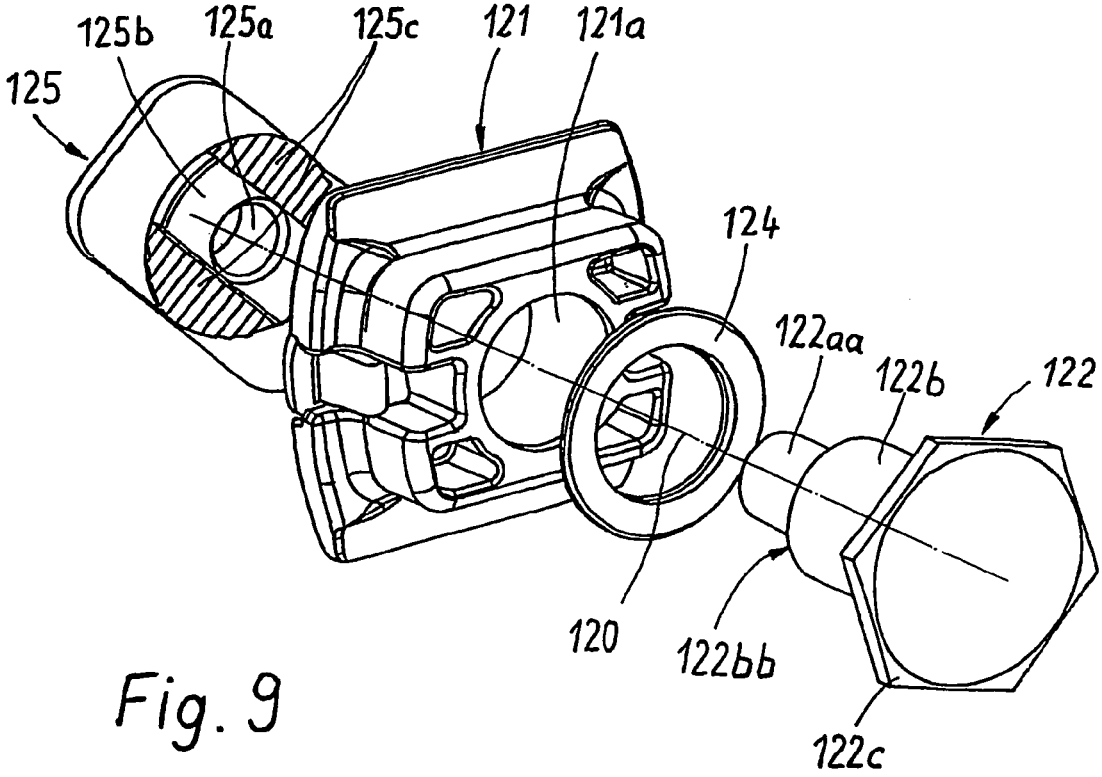
FIG. 9 shows a perspective exploded view of the means for adjusting the window lifter seen from the side of the base plate, but without base plate and lever arms.

In order to adjust the window lifter, a slide adjustment is applied as adjusting means for adjusting the relative angular position of the two lever arms 4, 5 according to the embodiment of FIGS. 8 and 9. The illustration of FIG. 8 shows an enlarged section of the window winding arm of FIG. 6 in the region of the adjusting means in a perspective view from the sides of the lever arms 4, 5. For reasons of improved clarity, the relevant adjusting means but without the base plate 1 and the lever arms 4, 5 are shown in FIG. 9 from the other side.

A slider 121 mounted in a displaceable manner in the slideway 12 has a cylindrical bearing surface 121*a* for holding the bearing section 122*b* of a fixing bolt 122, which is designed as a stepped bolt. This has on one side a head area 122*c* which adjoins the back of the base plate 1 through an elastic washer 124. The other side of the slider 121 is formed as a threaded section 122*aa* which engages through an oblong-hole type adjusting slideway 42' in the short lever arm 420 of the guide arm into the threaded section 125*a* of the nut 125. The adjusting slideway 42' extends in relation to the articulation axis 300 in the circumferential direction and has toothed positive locking elements 43 which are integrated in the sheet metal of the guide arm 4. These positive locking elements 43 are associated with positive locking elements 125*c* on the underneath of the nut 125 whose interengagement is to ensure the set position of the guide lever relative to the support axis 120—and thus also the relative angular position between the lever 4 and 5—even under the mechanical stresses which occur.

In order to prevent rotation of the nut 125 during operation of the fixing bolt 122, a squared projection 125*b* protrudes on the underneath of the nut 125 and can engage in the adjusting slideway 42' with its edges supported on the adjusting slideway 42'.

Figure 10:
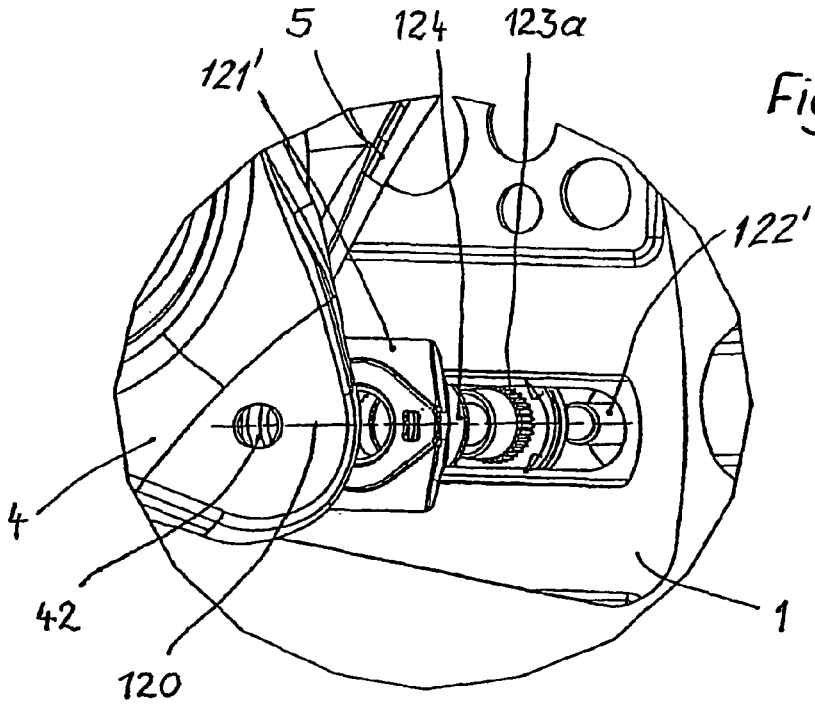
FIG. 10 shows a perspective exploded view of a section of the window lifter in the region of the adjusting means seen from the side of the lever arms whereby the short lever end of the guide lever in the region of the pivotal axis has a round hole in which an eccentrically mounted bolt can engage.
Figure 11:
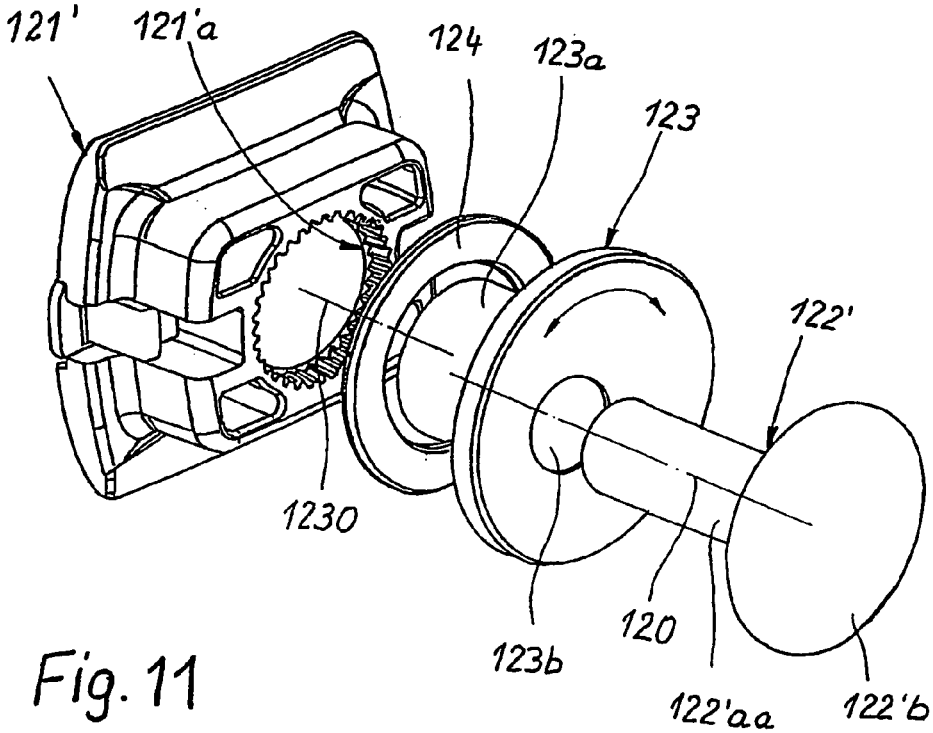
FIG. 11 shows a perspective exploded view of the means for adjusting the window lifter seen from the side of the base plate but without base plate and lever arms.

According to a further variation of the invention which is shown in FIGS. 10 and 11, adjusting means are provided which enable an eccentric type positioning of the fixing bolt 122' which fixes the supporting axis 120. For this purpose the slider 121' has a socket opening with internal toothing 121'*a* into which the external toothing 123*a* of the cylinder section of the base part 123 can engage. In the base part 123 there is a cylindrical channel 123*b* mounted eccentric relative to the rotational axis 1230 of the base part 123 and in which is pushed the shaft 122'*aa* of the fixing bolt 122', which has a head area 122'*b* at its end. By varying the rotary position of the base part 123 it is thus possible to adjust the position of the support axis 120.

The adjusting device described enables a finer adjustment the finer the teeth of the toothings 121'*a*, 123*a* are. It is pointed out, however, that the bearing capacity has to be adapted sufficiently to the mechanical stresses which are expected in the region of the support axis 120.

The invention claimed is:

1. A window lifter for a motor vehicle comprising:

a first lever arm pivoting about a pivotal axis;

an output element having a toothed segment with toothing thereon and an opening extending along the toothing, the toothed segment pivoting about the pivotal axis and fixedly connected to the first lever arm;

an axle element extending through the opening of the toothed segment;

a drive unit which is connected to the first lever arm through the output element;

a drive pinion connected to the drive unit which engages the toothing of the toothed segment;

a second lever arm, the second lever arm is connected pivotally to the first lever arm and is pivotable relative the first lever arm about an articulation axis spaced from the pivotal axis the second lever arm having a longer side and a shorter side shorter than the longer side and opposite the longer side, the longer and shorter sides being defined by an intersection of the articulation axis with the second lever arm; and a slideway in which the axle element is guided, wherein the axle element is mounted on the shorter side of the second lever arm.

2. A window lifter according to claim 1 wherein a base plate is provided on which the axle element and the drive unit are disposed and in which the slideway is integrated.

3. A window lifter according to any one of claims 1 or 2 wherein a slide element is guided in the slideway and accommodates the axle element.

4. A window lifter according to claim 2 wherein a longitudinal axis of the slideway extends substantially along a connecting line which intersects the pivotal axis and a rotational axis of the drive pinion.

5. A window lifter according to claim 4 wherein the slideway extends between the pivotal axis and the rotational axis of the drive pinion, and the articulation axis lies between the pivotal axis and the toothing of the toothed segment.

6. A window lifter according to claim 1 wherein the first and second lever arms are each connected at one end thereof to a window pane.

7. A window lifter according to claim 6 wherein the toothed segment is connected to the first lever arm so that the toothing points substantially in the direction of the end of the first lever arm which is connected to the window pane.

8. A window lifter according to claim 1 wherein a distance between the articulation axis and the axle element and a distance between the articulation axis and the pivotal axis are approximately the same.

9. A window lifter according to claim 1 further comprising adjusting means in the for adjusting a relative angular position between the first lever arm and the second lever arm.

10. A window lifter according to claim 9 wherein the adjusting means are spaced from the articulation axis by at most a third of the distance between the articulation axis and a connection formed by the second lever arm and a window pane.

11. A window lifter according to claim 9 or 10 wherein said adjusting means comprises an adjusting slide guide located in the second lever arm and a fixing element said, through said adjusting slide guide axle element passes whereby said fixing element fixes a position of the second lever arm relative to the axle element.

12. A window lifter according to claim 11 wherein along the adjusting slide guide are aligned positive locking elements which can be brought into engagement with positive locking elements of the fixing element, whereby an internal thread of the fixing element corresponds to an external thread of the axle element.

13. A window lifter according to claim 12 wherein the adjusting slide guide positive locking elements are located on the second lever arm and comprise a toothing.

14. A window lifter according to claim 12 wherein the positive locking elements on the fixing element are integrated in a contact bearing face of the fixing element.

15. A window lifter according to claim 12 wherein a projection is raised from a contact bearing face of the fixing element, faces the second lever arm, engages in the adjusting slide guide, and serves as an anti-rotational lock.

16. A window lifter according to claim 9 or 10 wherein said adjusting means comprises a fixing opening in the second lever arm and a base part, said axle element is disposed in said fixing opening, whereby the axle element is mounted eccentric relative to said base part.

17. A window lifter according to claim 16 wherein the base part includes positive locking elements and a part supporting the base part has positive locking elements matching the positive locking elements of the base part.

18. A window lifter according to claim 17 wherein the base part has a cylindrical outer surface.

* * * * *

UNITED STATES PATENT AND TRADEMARK OFFICE

CERTIFICATE OF CORRECTION

PATENT NO. : 7,010,883 B2
APPLICATION NO. : 10/432660
DATED : March 14, 2006
INVENTOR(S) : Jaerpsten et al.

It is certified that error appears in the above-identified patent and that said Letters Patent is hereby corrected as shown below:

In the Claims

| | |
|---|---|
| Column 7, line 4, Claim 1 | After "pivotal axis",<br>Insert --,-- |
| Column 7, line 39, Claim 9 | Delete "in the" |
| Column 8, lines 8-9, Claim 11 | Delete "element said, through said adjusting slide guide axle element passes",<br>Insert --element, said axle element passes through said adjusting slide guide-- |

Signed and Sealed this

Eighteenth Day of September, 2007

JON W. DUDAS
*Director of the United States Patent and Trademark Office*